US010953897B2

(12) United States Patent
Mcquistian et al.

(10) Patent No.: US 10,953,897 B2
(45) Date of Patent: Mar. 23, 2021

(54) ELECTRONIC CIRCUIT CONTROLLER FOR RAILWAY SWITCH MACHINE, RAILWAY SWITCH MACHINE AND RAILWAY SWITCHING SYSTEM INCLUDING SAME

(71) Applicant: Ansaldo STS USA, Inc., Pittsburgh, PA (US)

(72) Inventors: Kevin Mcquistian, Apollo, PA (US); Eric Mcgraw, Aliquippa, PA (US); Russell Szewczyk, South Park, PA (US)

(73) Assignee: HITACHI RAIL STS USA, INC., Pittsburgh, PA (US)

( * ) Notice: Subject to any disclaimer, the term of this patent is extended or adjusted under 35 U.S.C. 154(b) by 630 days.

(21) Appl. No.: 15/722,798

(22) Filed: Oct. 2, 2017

(65) Prior Publication Data

US 2018/0093682 A1 Apr. 5, 2018

Related U.S. Application Data

(60) Provisional application No. 62/402,194, filed on Sep. 30, 2016.

(51) Int. Cl.

| | |
|---|---|
| ***B61L 1/02*** | (2006.01) |
| ***B61L 5/06*** | (2006.01) |
| ***B61L 5/10*** | (2006.01) |

(52) U.S. Cl.

CPC ..... *B61L 1/025* (2013.01); *B61L 5/06* (2013.01); *B61L 5/107* (2013.01)

(58) Field of Classification Search

CPC ..... B61L 1/025; B61L 5/06; B61L 5/107

USPC ..... 246/220

See application file for complete search history.

(56) References Cited

U.S. PATENT DOCUMENTS

| | | | | |
|---|---|---|---|---|
| 5,116,006 | A * | 5/1992 | Ocampo | B61L 5/107 246/162 |
| 5,620,156 | A * | 4/1997 | Berggren | B61L 5/10 246/221 |
| 5,806,809 | A * | 9/1998 | Danner | B61L 5/107 246/220 |
| 6,149,106 | A * | 11/2000 | McQuistian | B61L 5/107 246/220 |
| 6,164,600 | A * | 12/2000 | Seidl | B61L 5/107 246/220 |
| 6,186,448 | B1 * | 2/2001 | Wydotis | B61L 5/107 246/220 |
| 6,484,974 | B1 * | 11/2002 | Franke | B61L 5/107 246/220 |
| 6,585,194 | B1 * | 7/2003 | Brushwood | B61L 5/00 246/220 |
| 6,663,052 | B1 | 12/2003 | Brushwood | |

(Continued)

FOREIGN PATENT DOCUMENTS

| | | |
|---|---|---|
| CN | 201329879 U | 10/2009 |
| CN | 101439725 B | 1/2011 |

(Continued)

*Primary Examiner* — Jason C Smith

(74) *Attorney, Agent, or Firm* — Eckert Seamans Cherin & Mellott, LLC

(57) ABSTRACT

A railway switching machine includes a housing, a first point detector bar slidably coupled to the housing and structured to be directly coupled to a first switch point, and a second point detector bar slidably coupled to the housing and structured to be directly coupled to a second switch point.

14 Claims, 11 Drawing Sheets

(56) References Cited

U.S. PATENT DOCUMENTS

| | | | | |
|---|---|---|---|---|
| 6,688,559 | B1 | 2/2004 | Brushwood | |
| 7,577,502 | B1 * | 8/2009 | Henry | B61L 5/102 246/218 |
| 7,753,318 | B2 * | 7/2010 | Wagner | B61L 5/107 246/220 |
| 2007/0040071 | A1 * | 2/2007 | Oberhoffner | B61L 5/107 246/220 |
| 2008/0093508 | A1 * | 4/2008 | McQuistian | E01B 7/22 246/463 |
| 2013/0068897 | A1 * | 3/2013 | Arnold | E01B 7/02 246/476 |
| 2015/0028164 | A1 * | 1/2015 | Mariuzza, Jr. | G01M 99/00 246/253 |
| 2017/0002522 | A1 * | 1/2017 | Arnold | E01B 7/20 |
| 2018/0093682 | A1 * | 4/2018 | McQuistian | B61L 5/06 |

FOREIGN PATENT DOCUMENTS

| | | | |
|---|---|---|---|
| CN | 103786750 | B | 9/2015 |
| DE | 19819162 | B4 | 1/2008 |
| EP | 1593575 | B1 | 6/2006 |
| EP | 2939900 | A1 | 11/2015 |

* cited by examiner

ELECTRONIC CIRCUIT CONTROLLER FOR RAILWAY SWITCH MACHINE, RAILWAY SWITCH MACHINE AND RAILWAY SWITCHING SYSTEM INCLUDING SAME

CROSS-REFERENCE TO RELATED APPLICATIONS

This patent application claims the priority benefit under 35 U.S.C. § 119(e) of U.S. Provisional Application No. 62/402,194 entitled "Electronic Circuit Controller for Railway Switch Machine, Railway Switch Machine and Railway Switching System Including Same, filed on Sep. 30, 2016, the contents of which are herein incorporated by reference.

BACKGROUND OF THE INVENTION

1. Field of the Invention

The present application relates to vital controllers for switch machines and, more particularly, to vital electronic circuit controllers for use in railway switch machines or for transit and/or railway related vital proximity detection applications. The present application also relates to railway switch machines and railway switching systems including such controllers.

2. Description of the Related Art

A railway switch machine is used to divert a train from one track to, another track. In many cases, the switch machine is remotely operated and, thus, an operator cannot see the machine. Consequently, the status of the machine (e.g., points detected and mechanically locked for either a straight-through or turn-out move) is provided by electrical circuits that, in turn, are interlocked with signals governing movement of the trains. According to typical convention, the term Normal (N) is employed for a straight-through move and the term Reverse (R) is employed for a turn-out move.

Historically, indication circuits for switch machines were implemented with cam operated or other types of mechanical switches comprises of hard contacts within the machine. In some cases, the indication contacts of one machine are electrically connected in series with other machines in series for a cross-over to provide a system safety connection to both sets of points. All interconnected machines must prove that their points are closed and mechanically locked before railroad signals are cleared for traffic, in order to permit movement of associated trains.

Motor control is also provided by mechanical switches via hard contacts. Basically, the motor rotates in opposite directions for Normal and Reverse. Rotary motion of the motor is converted to linear motion within the machine to move and lock the points. If the motor is being driven Normal, then contacts within the machine open the circuit path that would, otherwise, permit continued movement in that direction when the limit of intended motion is reached. However, a path is maintained that permits movement in the Reverse direction. In between the extreme positions, both current paths are closed for movement of the motor in either direction. It is known to assign Right Hand Points Closed (RHPC) or Left Hand Points Closed (LHPC) to Normal by orientation of cam operated switches.

With mechanical controllers, a battery voltage is fed from the wayside case to contacts of a first switch machine. Then, if those contacts are closed, the battery voltage is fed on to the next machine, and so on. If all the contacts in the series string are closed, then the voltage fed back to the wayside case proves all switch machines are in correspondence, which is a condition necessary to vitally clear signals.

Electronic circuit controllers have been developed which improve upon such mechanical devices. For example, U.S. Pat. No. 6,484,974, the contents of which are incorporated herein by reference, discloses an example of such an electronic circuit controller (ECC). The ECC is a microprocessor controlled device used to sense the position of rail points within a turnout(s) or "switch". Similar to purely mechanical sensing systems, the sensing of the points is provided by a point detector bar which attaches to heavy metalwork binding two switch points together at a set distance. The point detector bar is able to slide freely within the controller compartment of the switch machine. Unlike purely mechanical systems which utilize cams to interact with the point detector bar, a target attached to the point detector bar is utilized which is aligned with an inductive proximity sensor in each switch position. Other sensors are mounted under the mounting plate to sense the lock box position at the end of each move (near and far point positions). The lock box (which mechanically locks the track in its full thrown position), when used, prohibits unintended point movement until unlocked for the next switch move.

FIG. 1 shows an example of a prior art railway switching system 10 including an ECC 12, such as described in U.S. Pat. No. 6,484,974, provided in a switch machine 14 which is disposed in the closed, "NORMAL" position, while FIG. 2 shows switch machine 14 disposed in its open or "REVERSE" position. (This nomenclature is based on the right point being normally closed as viewed looking toward the points. The Normal position is most often the non-diverging route of the straight move.) When in the Normal position, a target 16 is aligned with a Vital Normal Point proximity sensor 18 which is electrically connected to ECC 12. Conversely, when in the Reverse position, target 16 is aligned with a Vital Reverse Point proximity sensor 20 which is also electrically connected to ECC 12. It is to be appreciated that the example switch machines shown in FIGS. 1-5 herein are arranged as far point indication machines.

Vital proximity sensors 18, 20 have a narrow valid current window for both "in-range" and "out-of-range" indications but never full open or shorted conditions of the sensors can be interpreted by the ECC as acceptable. ECC 12 has the ability to verify the proper current with the use of a vital analog input. Each of sensors 18 and 20 are connected to the sinking input of the vital analog input. Through the use of sensor select circuits each sensor 18, 20 can be individually powered and read. ECC 12 employs time division multiplexing to read each vital sensor input current. The linearity of the analog input gain stage and analog-to-digital converter is verified with a ramping test signal before which are verified to be accurate between every read of the sensors.

Such approach has provided reliable railroad switch machine position indication for over 10 years. In most rail markets, including the US, it has generally been deemed acceptable practice to receive the position indication through a single point detector bar (via either mechanical or electrical sensing) for over 100 years. However, such methodology is not without its flaws as such system could incorrectly indicate the switch machine position if the closed point were to become disconnected from the metalwork binding the two points. In such scenario, an example of which is shown in FIG. 3, the point detector bar and track would remain connected to the open point. The point detector bar would indicate the correct position of the track work and the open point. The closed point, however, may not be in contact with the running rail. This could create a hazardous condition. For this reason, certain market requirements dictate that switch machine points must be independently monitored.

Accordingly, there remains a substantial need (e.g., personnel safety, equipment safety) to provide a system and method for independently monitoring both switch points in a railway switching system.

SUMMARY

Embodiments of the present concept improve upon known solutions and add protection against the unsafe scenario described in the Background section in several ways. As one aspect of the invention, a railway switching machine comprises: a housing; a first point detector bar slidably coupled to the housing and structured to be directly coupled to a first switch point; and a second point detector bar slidably coupled to the housing and structured to be directly coupled to a second switch point.

The housing may include a first number of proximity sensors positioned to detect a target provided on the first point detector bar and a second number of proximity sensors positioned to detect a target provided on the second point detector bar.

The railway switching machine may further comprise an intelligent electronic circuit controller electrically connected to each of the first number of proximity sensors and the second number of proximity sensors. The intelligent electronic circuit controller may comprise a control unit having a processing unit and a memory. The processing unit may be structured to store data regarding performance of the switching machine. The intelligent electronic circuit controller may further comprise a communication unit structured to communicate between the control unit and external devices via one or more wired or wireless communication means.

Each of the first point detector bar and the second point detector bar may be moveable from between a first position wherein the target disposed thereon is positioned at or about a first proximity sensor of the number of proximity sensors and a second position wherein the target disposed thereon is disposed about a second proximity sensor; and the processing unit may be programmed to log a quantity of said movements of one or both of the first point detector bar and the second point detector bar between said first and second positions along with one or more of: a time duration required to compete each of said movements and a current draw of the switching machine during one or more of said movements. The processing unit may be further programmed to compare one or more of the time duration and current draw to a predetermined value and provide a signal if the comparison satisfies a predetermined condition.

As another aspect of the invention, a railway switching system comprises: a first switch point; a second switch point; and a railway switching machine comprising: a housing; and a first point detector bar slidably coupled to the housing and directly coupled to only one of the first switch point or the second switch point.

The railway switching machine may further comprise a second point detector bar slidably coupled to the housing and directly coupled to the other one of the first switch point or the second switch point. The housing of the railway switching machine may include a first number of proximity sensors positioned to detect a target provided on the first point detector bar and a second number of proximity sensors positioned to detect a target provided on the second point detector bar.

The railway switching machine may further comprise an intelligent electronic circuit controller electrically connected to each of the first number of proximity sensors and the second number of proximity sensors. The intelligent electronic circuit controller may comprise a control unit having a processing unit and a memory. The processing unit may be structured to store data regarding performance of the switching machine. The intelligent electronic circuit controller may further comprise a communication unit structured to communicate between the control unit and external devices via one or more wired or wireless communication means. Each of the first point detector bar and the second point detector bar may be moveable from between a first position wherein the target disposed thereon is positioned at or about a first proximity sensor of the number of proximity sensors and a second position wherein the target disposed thereon is disposed about a second proximity sensor; and the processing unit may be programmed to log a quantity of said movements of one or both of the first point detector bar and the second point detector bar between said first and second positions along with one or more of: a time duration required to compete each of said movements and a current draw of the switching machine during one or more of said movements. The processing unit may be further programmed to compare one or more of the time duration and current draw to a predetermined value and provide a signal if the comparison satisfies a predetermined condition.

DETAILED DESCRIPTION OF EXEMPLARY EMBODIMENTS

Figure 1:
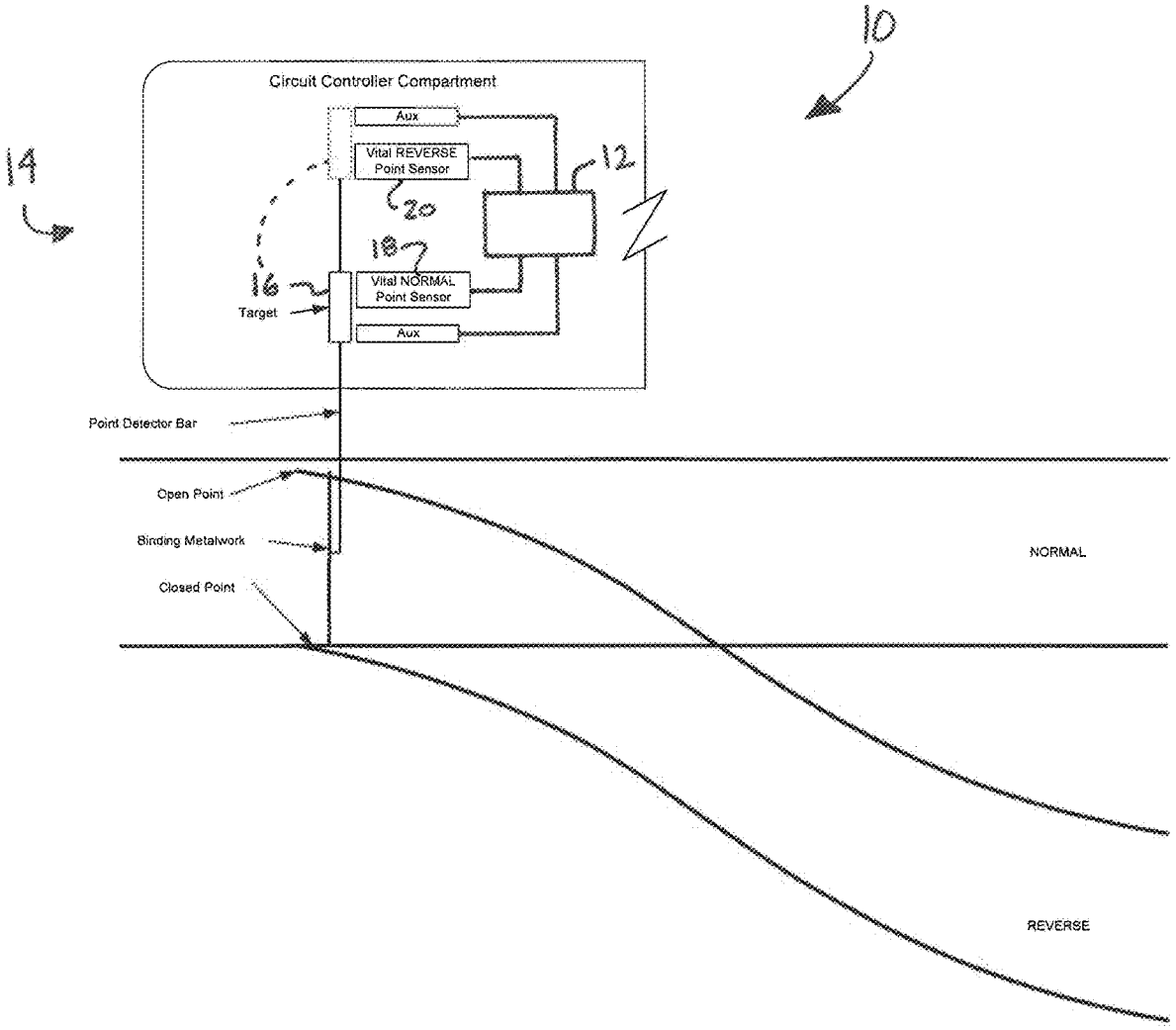
PRIOR ART FIG 1.
FIG. 1 is a schematic diagram of an example of a prior art railway switching system shown disposed in a first, "Normal", position.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Embodiments of the present concept improve upon known solutions and add protection against the unsafe scenario described in the Background section in several ways. First, a second point detector bar is added such that one point detector bar is attached to each point independently. The inductive proximity sensors are positioned to sense a target on each point detector bar when each point is closed. This addition alone greatly reduces the possibility that either point could become deranged without detection by the intelligent electronic circuit controller (IECC). Second, the inclusion of two additional vital proximity sensors improves the ability of the IECC to detect improper switch point positions and to detect the position of the open points in each position of the switch. With this arrangement, in order to produce a vital indication of switch position, not only the closed-point positions must be detected, but proper open-point position sensing is also required. Such arrangement adds a level of safety beyond what is possible with conventional circuit controller configurations.

Figure 3:
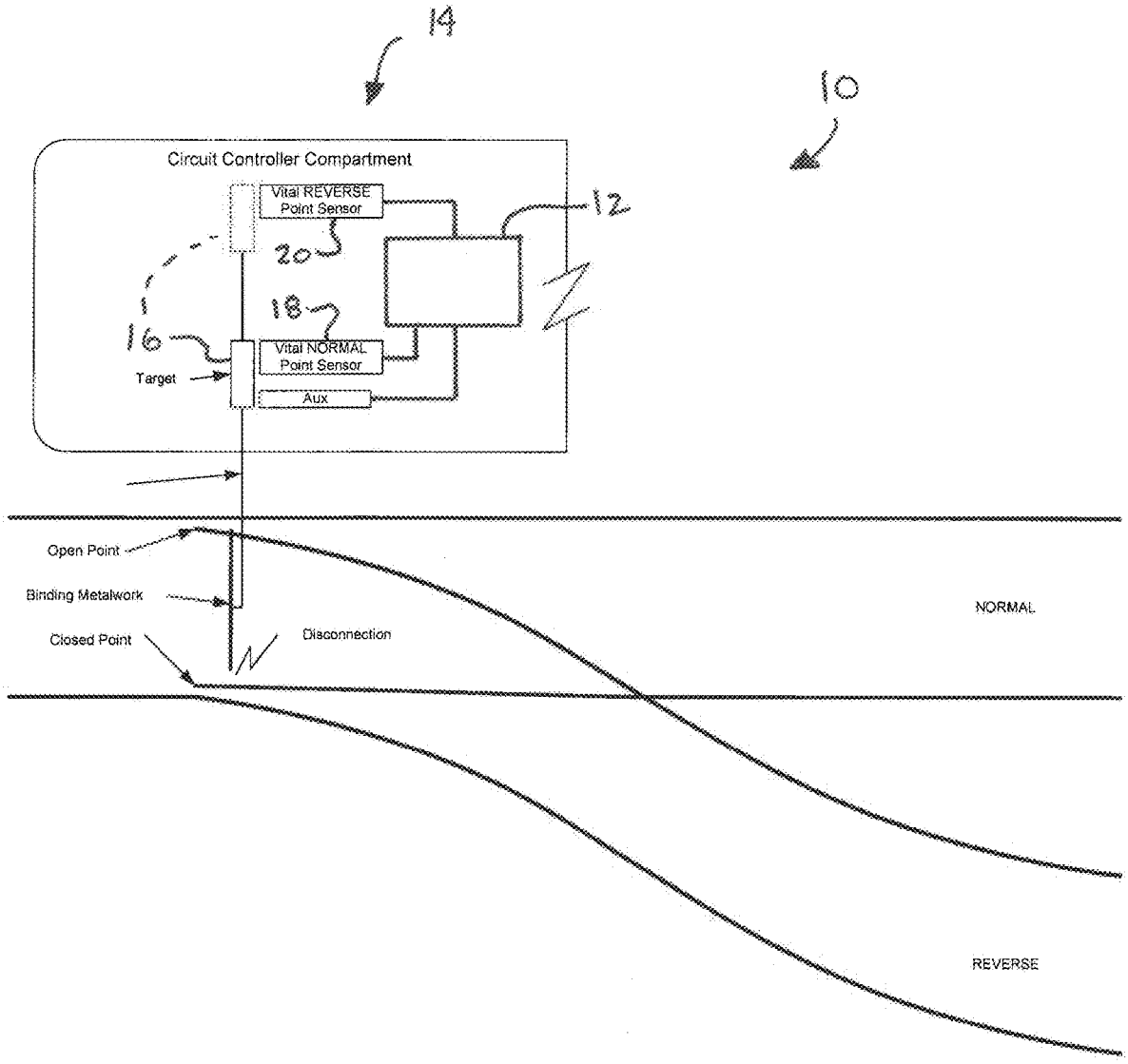
PRIOR ART FIG. 3
FIG. 3 is a schematic diagram of the railway switching system of FIG. 1 shown in with a disconnection between portions thereof.
Figure 4:
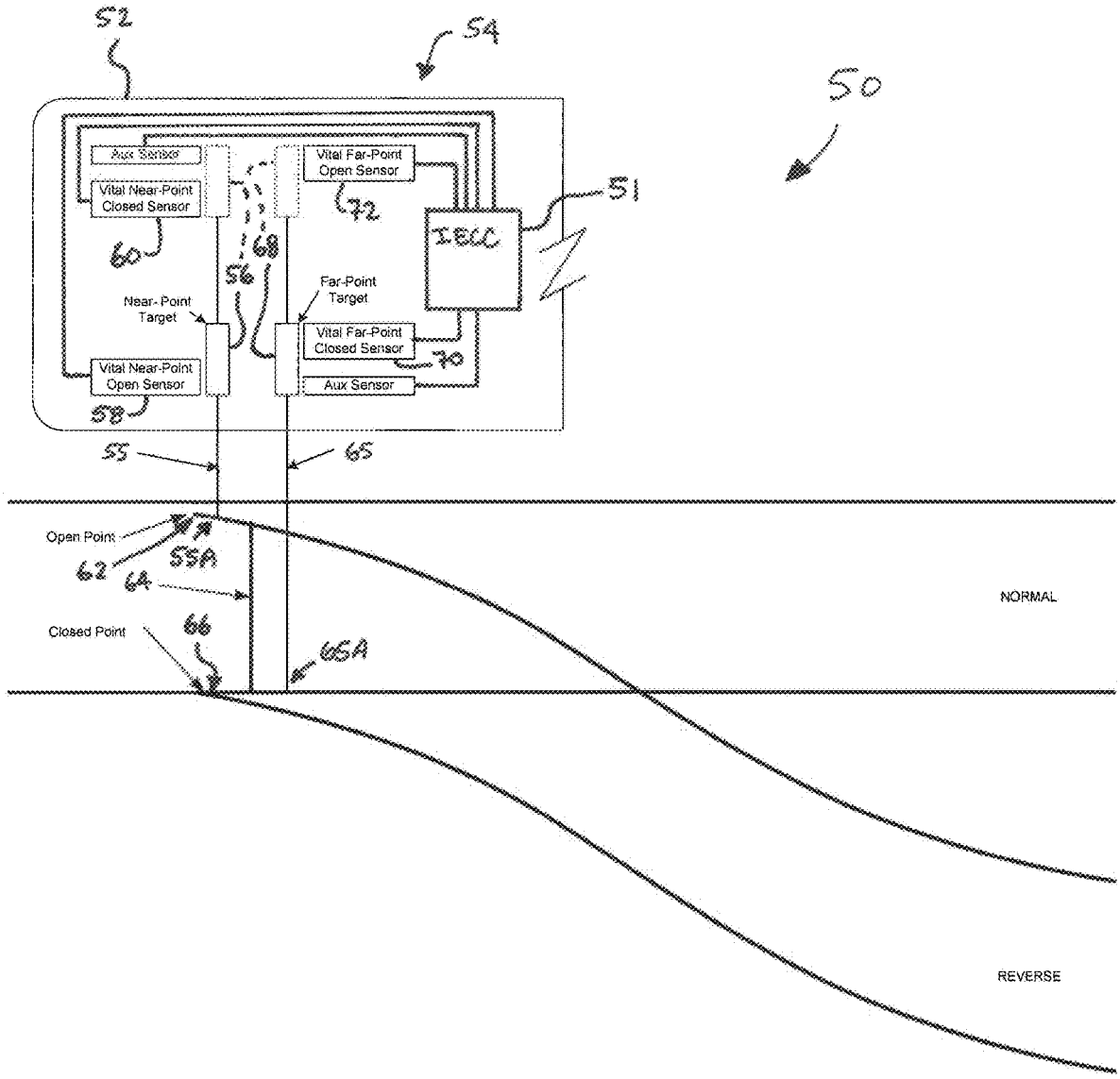
FIG. 4 is a schematic diagram of an example railway switching system in accordance with an embodiment of the present concept shown disposed in a first, "Normal", position sensing both open and closed points.
Figure 5:
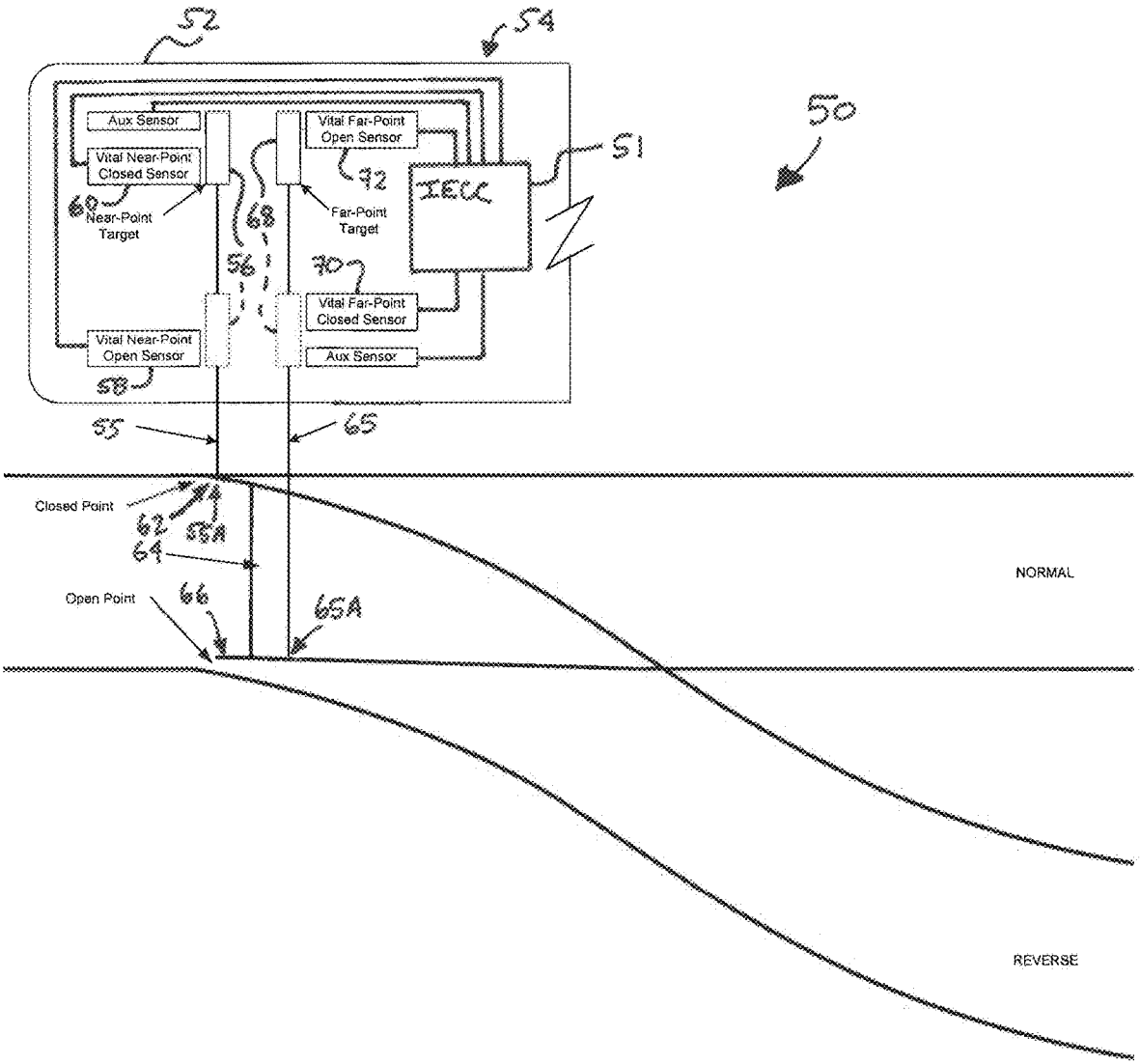
FIG. 5 is a schematic diagram of the example railway switching system of FIG. 4 shown disposed in a second, "Reverse", position sensing both open and closed points.

FIG. 4 shows schematically an example embodiment of a railway switching system 50 including an IECC 51 provided in a housing 52 of a switch machine 54 which is disposed in the closed, "NORMAL" position. FIG. 5 shows switch machine 54 disposed in its open or "REVERSE" position. Switch machine 54 may be of a generally similar arrangement as the switch machine described in U.S. Pat. No. 6,484,974, and as such includes a first point detector bar 55 slidably coupled to housing 52 such that a distal end 55A thereof can slide toward and away from housing 52. Switch machine 54 includes a number of proximity sensors 58, 60 (which are electrically connected to IECC 51) disposed thereby to detect a target 56 provided on first point detector bar 55 in a similar manner as previously described in the arrangement of FIGS. 1-3. However, unlike the prior art arrangement, first point detector bar 55 is coupled (at or about distal end 55A) directly to the near switch point 62, and not to the binding metalwork 64 which couples near switch point 62 and far switch point 66. Hence, first point detector bar 55 functions as a near point detector bar with sensors 58 and 60 serving to indicate when near point 62 is in an open position (FIG. 4) or a closed position (FIG. 5).

Figure 2:
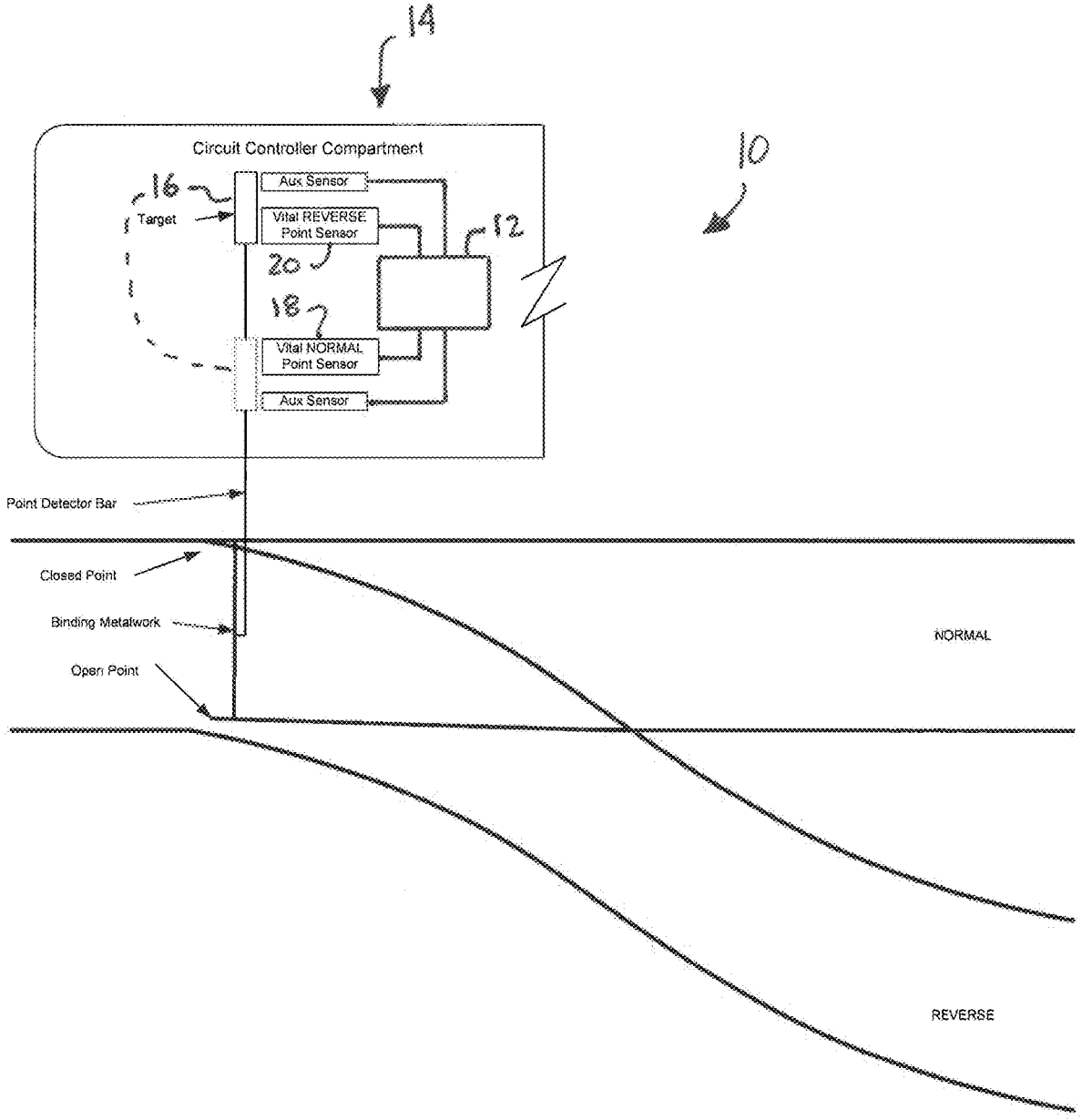
Prior Art FIG. 2
FIG. 2 is a schematic diagram of the railway switching system of FIG. 1 shown in a second, "Reverse", position.

As a further distinction from the prior art arrangement previously described in conjunction with FIGS. 1-3, switch machine 54 further includes a second point detector bar 65 which is coupled directly (at or about a distal end 65A) to far point 66. Hence, second point detector bar 65 functions as a far point detector bar and includes a far point target 68 disposed thereon which is detected by a vital far-point closed proximity sensor 70 when far point 66 is in a closed position, and thus system 50 is disposed in an open position (FIG. 4), or which is detected by a vital far-point open proximity sensor 72 when far point 66 is in a closed position, and thus system 50 is disposed in a reverse position (FIG. 5). Each of proximity sensors 70 and 72 are electrically connected to IECC 51.

Figure 6:
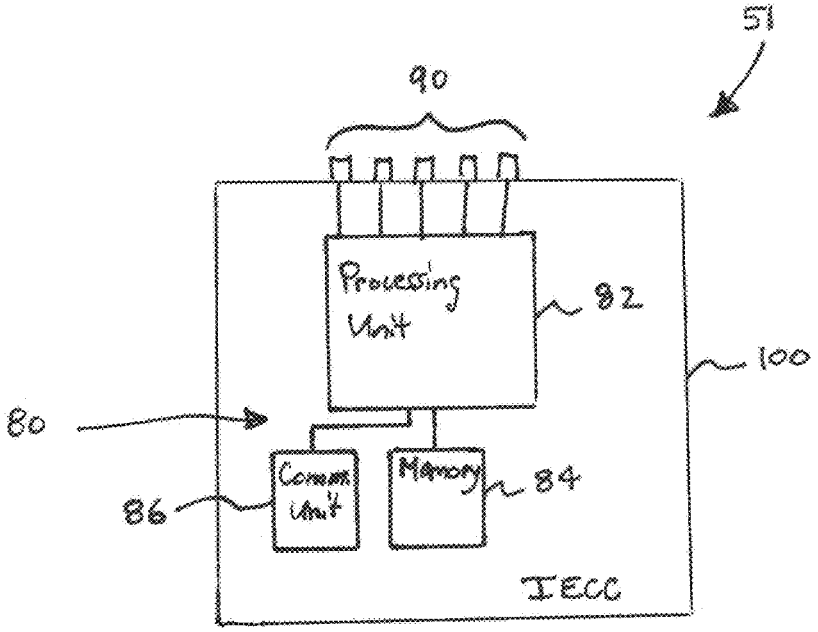
FIG. 6 is a schematic representation of an example IECC in accordance with an embodiment of the present concept.

Referring now to FIG. 6, in its most basic form, IECC 51 includes a control unit 80 comprising a processing unit 82, a memory 84, and a communications unit 86. Processing unit 82 may be, for example and without limitation, a microcontroller or a microprocessor or other suitable processing device that interfaces with a suitable memory device. Memory 84 can be any one or more of a variety of types of internal and/or external storage media such as, without limitation, RAM, ROM, EPROM(s), EEPROM(s), FLASH, and the like that provide a storage register, i.e., a non-transitory machine readable medium, for data storage such as in the fashion of an internal storage area of a computer, and can be volatile memory or nonvolatile memory. Memory 84 of control unit 80 has stored therein a number of routines that are executable by processing unit 82 of control unit 80. Control unit 80 is electrically connected to a number of electrical connectors 90 disposed on or about a water tight enclosure 100 which encloses control unit 80. Communication unit 86 may provide for communication between control unit 80 and other external devices via ethernet, internet, cellular, WiFi, fiber optic cabling, wired telephone line, or any other suitable means. For example, without limitation, communication unit 86 may facilitate communication with electronic devices such as a phone, tablet, computer, or other devices whether local or distant, directly or via a network. Communication facilitated by communication unit 86 may allow processing unit 82 to send and/or receive data from the component or device with which it communicates.

Figure 7:
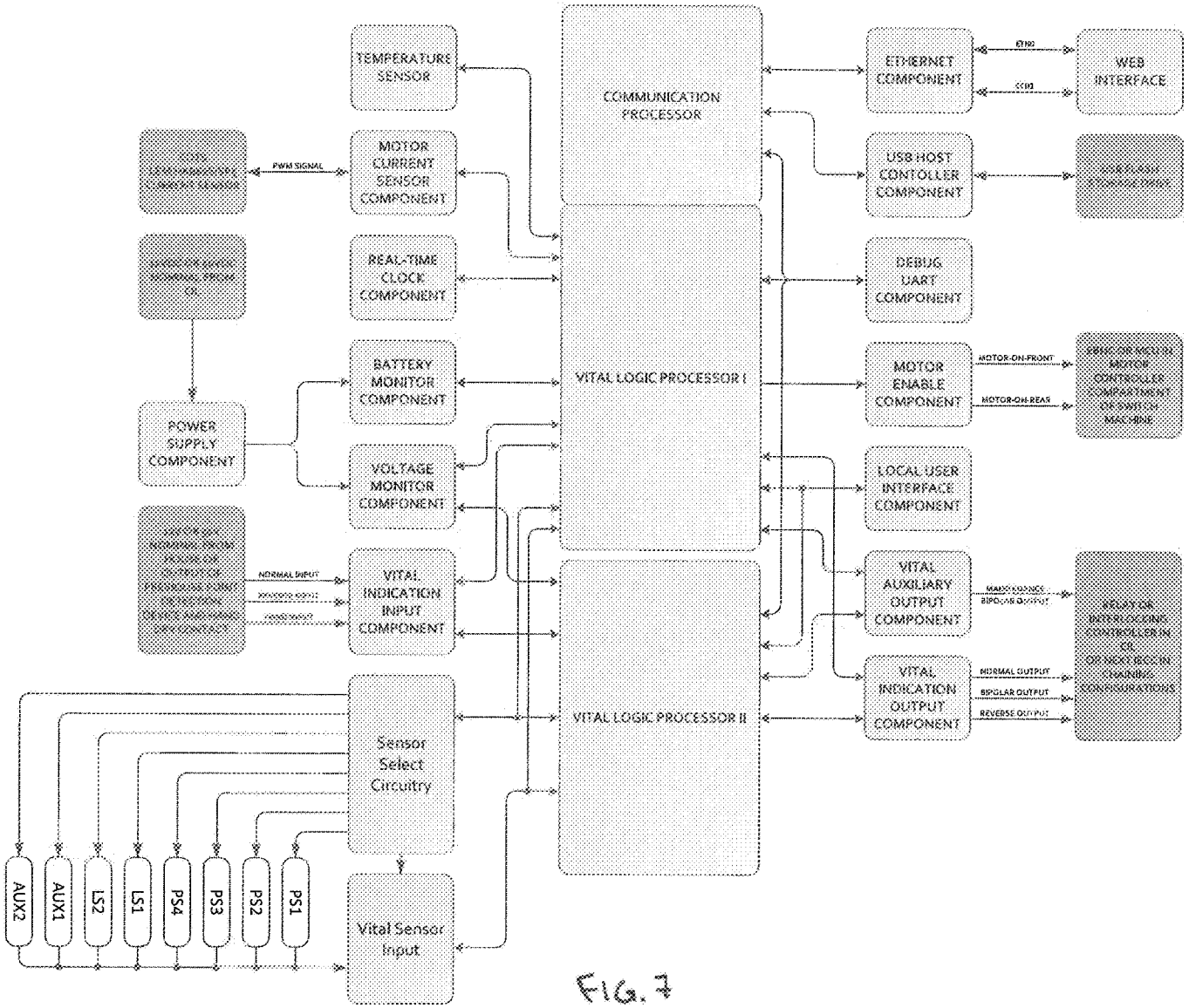
FIG. 7 is a schematic representation showing components of an IECC and components related thereto in accordance with an embodiment of the present concept.
Figure 8:
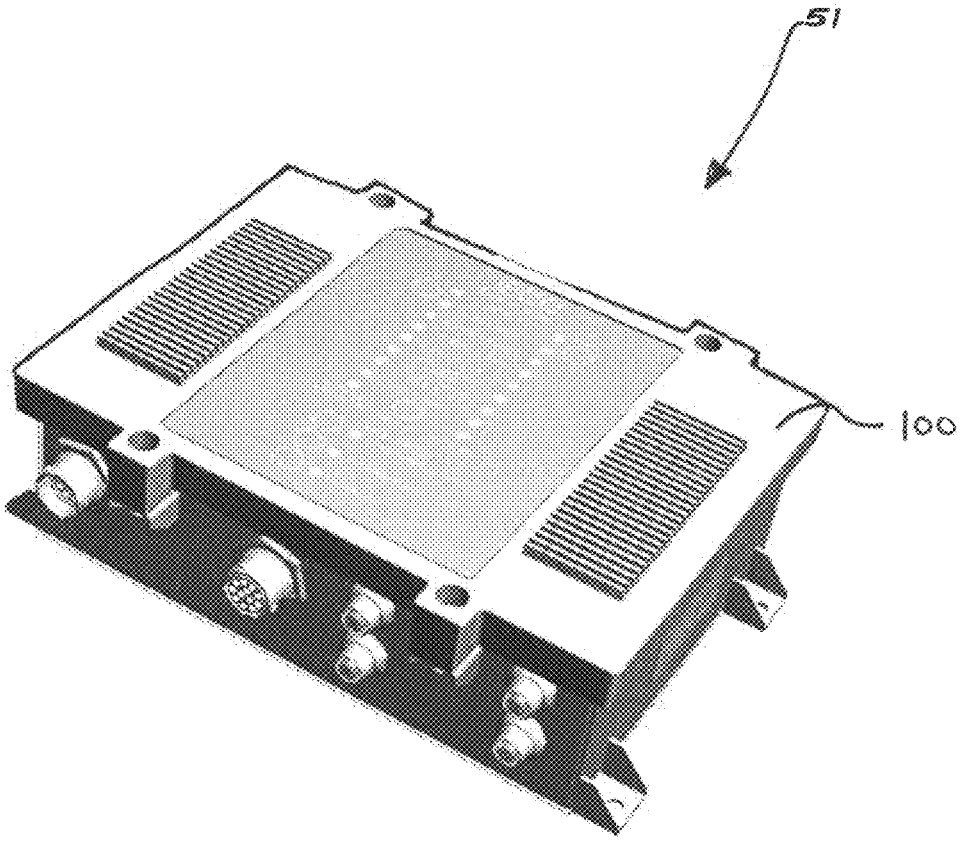
FIG. 8 shows an isometric view of an IECC in accordance with an example embodiment of the present concept.
Figure 9:
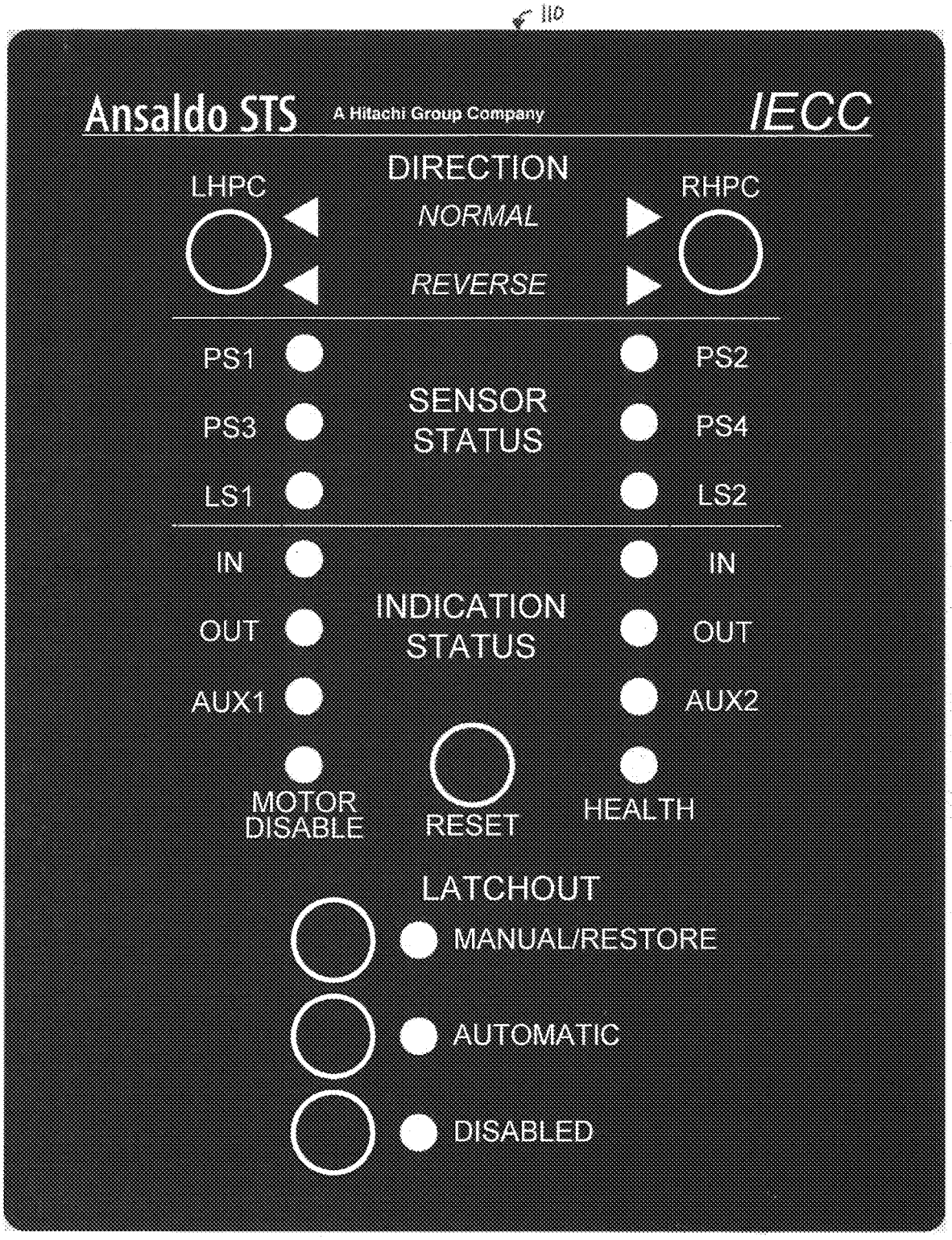
FIG. 9 shows a view of the indicators provided on an IECC in accordance with an example embodiment of the present concept.

It is to be appreciated that the arrangement of FIG. 6 is provided for example purposes only and that IECC 51 may include other components without varying from the scope of the present concept. As an example, FIG. 7 shows a schematic diagram of electrical components in an example embodiment of a controller in accordance with the present concept. In such example, two field-programmable gate arrays (FPGAs) are used as vital logic processors (i.e., "vital logic processor I" and "vital logic processor II") to execute the identical logic. Before asserting a vital indication output, both processors compare results based on the same input data, sensor readings, vital inputs, etc. Because each FPGA is configured uniquely, due to the use of diverse proprietary place and route techniques (example: Altera® and Xilinx®), common mode failures associated with simple redundant architectures are eliminated. FIG. 8 shows an isometric view of an IECC in accordance with an example embodiment of the present concept and FIG. 9 shows a view of indicators 110 provided on an IECC in accordance with an example embodiment of the present concept.

An IECC as described herein provides for data logging and remote diagnostic capabilities giving rail maintenance personnel added insight into switch machine performance and maintenance needs without being near the switch machine of interest. For example, without limitation, parameters such as the number of switch machine throws, time duration of switch throws measured against "optimal performance" for profiling and threshold alarms, real time of switch machine throws, switch machine motor current draw, etc. can be logged and alarms could alert railroad personnel when machine maintenance is necessary. Additionally, an IECC as described herein provides for indications over vital communications, web interfacing for greater user information on machine performance, and messaging to user's maintenance team via text or other suitable arrangement. Such capabilities provide for railroad personnel to more accurately allocate resources to apply maintenance to the proper switch machines. For example, without limitation, an alarm could be set to indicate that the current draw of the machine motor exceeds a predetermined threshold(s), thus indicating that components of the railway switching system likely need to be greased or serviced in an appropriate manner, the switch mechanism is beginning to fail due to internal components failing or requiring lubrication, the location of the points is beginning to become out of range, power source to machine is weak or overcharged, and if undesired debris has entered the overall switch location. Because each machine log can be accessed individually, the maintenance crew can also tell exactly which machine is in need of maintenance in those cases in which all the indication outputs are chained serially.

Figure 10:
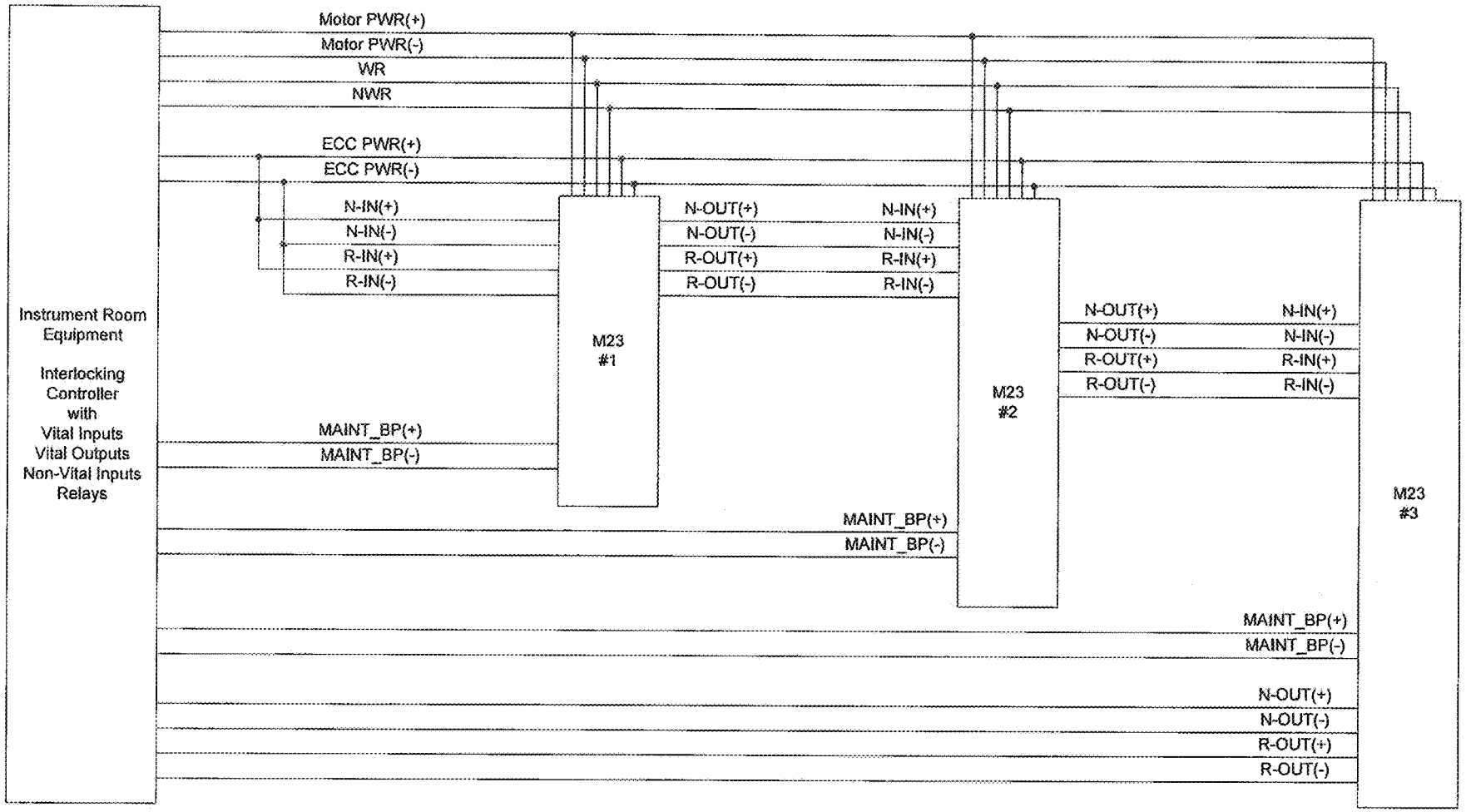
FIG. 10 shows a schematic representation of a plurality of switch machines arranged in a "chained" configuration in accordance with an example embodiment of the present concept.

An IECC as described herein can support two-way vital communications over Ethernet or fiber optic cabling. The existing electronic and electro-mechanical controllers communicate the switch position via discrete indications. When multiple switches are combined in an interlocking manner (known as "chaining"), the switch position indications are passed from one controller to the next. Ultimately the last controller indication outputs are sent back to the wayside relay logic or vital logic. If any of the machines in the chain become out-of correspondence, no indication will be sent to the wayside logic to allow train movement over the switch (es). Separate 12 VDC signals are sent to the wayside logic for NORMAL and REVERSE indicating each switch position. An example of such arrangement is illustrated in FIG. 10. In another example embodiment, 50 VDC signals are utilized.

An IECC as described herein can be field configured for different latch out types such as: automated latch out restore, manual latch out restore, and disabled (will not ever latch out).

Figure 11:
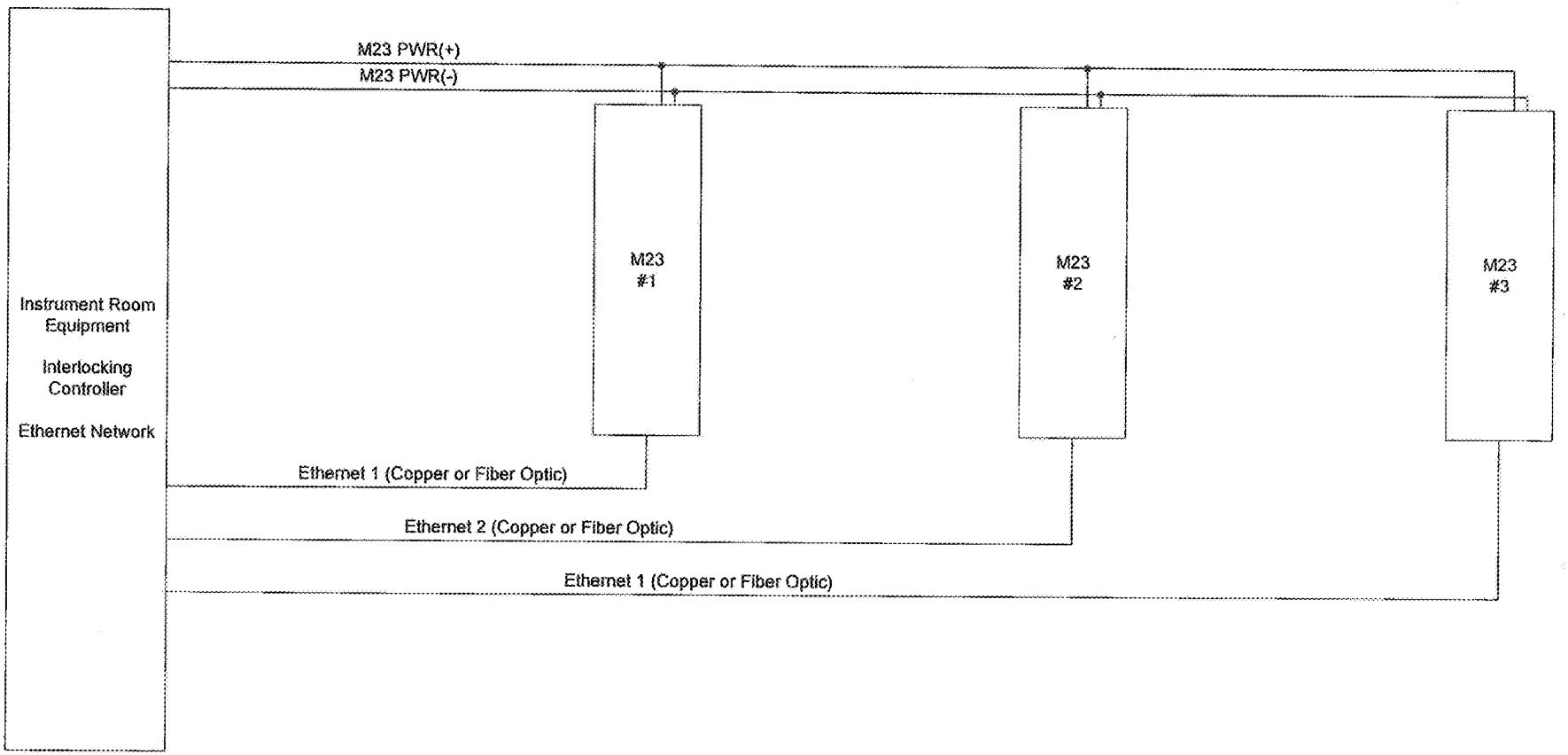
FIG. 11 shows a schematic representation of a plurality of switch machines arranged in a "chained" configuration in accordance with another example embodiment of the present concept.

Embodiments of the present concept allow for switch position indications to be vitally conveyed from the switch machine to the wayside logic, or from a switch machine to the next switch machine in a chain of interlocked switch machines, over an Ethernet or fiber optic connection. An example of such an arrangement is illustrated in FIG. 11. This eliminates the need for discrete buried cabling currently used to pass the indications. More importantly perhaps, is the elimination of the possibility that stray electrical signals could couple onto the discrete input/output lines, and falsely provide a switch position indication output.

In addition, with a vital communication link between the wayside logic and switch machines in the field, it is possible to request a switch move. The IECC circuit controller could then pass the move request to the motor controllers used to throw the machine via discrete outputs. The primary benefit of doing this is the ability to eliminate two or three more discrete conductors from the machine to the wayside house or case, previously sent to the switch machine motor controller independently.

The vital communication link and independent control of the motor eliminates the need of additional components in the wayside controller which are used to remove power to the motor after indication is sent or overload cutoff if the current is exceeded for an extended period of time.

Although the present concept has been described in detail for the purpose of illustration based on what is currently considered to be the most practical and preferred embodiments, it is to be understood that such detail is solely for that purpose and that the concept is not limited to the disclosed embodiments, but, on the contrary, is intended to cover modifications and equivalent arrangements that are within the spirit and scope of the appended claims. For example, it is to be understood that the present concept contemplates that, to the extent possible, one or more features of any embodiment can be combined with one or more features of any other embodiment.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A railway switching machine comprising:

a housing;

a first point detector bar slidably coupled to the housing and structured to be directly coupled to a first switch point; and a second point detector bar slidably coupled to the housing and structured to be directly coupled to a second switch point, wherein the housing includes a first number of proximity sensors positioned to detect a target provided on the first point detector bar and a second number of proximity sensors positioned to detect a target provided on the second point detector bar, and wherein each of the first point detector bar and the second point detector bar are moveable from between a first position wherein the target disposed thereon is positioned at or about a first proximity sensor of the number of proximity sensors and a second position wherein the target disposed thereon is disposed about a second proximity sensor.

2. The railway switching machine of claim 1, further comprising an intelligent electronic circuit controller electrically connected to each of the first number of proximity sensors and the second number of proximity sensors.

3. The railway switching machine of claim 2, wherein the intelligent electronic circuit controller comprises a control unit having a processing unit and a memory.

4. The railway switching machine of claim 3, wherein the processing unit is structured to store data regarding performance of the switching machine.

5. The railway switching machine of claim 3, wherein the intelligent electronic circuit controller further comprises a communication unit structured to communicate between the control unit and external devices via one or more wired or wireless communication means.

6. The railway switching machine of claim 3, wherein the processing unit is programmed to log a quantity of said movements of one or both of the first point detector bar and the second point detector bar between said first and second positions along with one or more of: a time duration required to compete each of said movements and a current draw of the switching machine during one or more of said movements.

7. The railway switching machine of claim 6, wherein the processing unit is further programmed to compare one or more of the time duration and current draw to a predetermined value and provide a signal if the comparison satisfies a predetermined condition.

8. A railway switching system comprising:

a first switch point;

a second switch point; and a railway switching machine comprising:

a housing; and a first point detector bar slidably coupled to the housing and directly coupled to only one of the first switch point or the second switch point, wherein the railway switching machine further comprises a second point detector bar slidably coupled to the housing and directly coupled to the other one of the first switch point or the second switch point, wherein the housing of the railway switching machine includes a first number of proximity sensors positioned to detect a target provided on the first point detector bar and a second number of proximity sensors positioned to detect a target provided on the second point detector bar, and wherein each of the first point detector bar and the second point detector bar are moveable from between a first position wherein the target disposed thereon is positioned at or about a first proximity sensor of the number of proximity sensors and a second position wherein the target disposed thereon is disposed about a second proximity sensor.

9. The railway switching system of claim 8 wherein the railway switching machine further comprises an intelligent electronic circuit controller electrically connected to each of the first number of proximity sensors and the second number of proximity sensors.

10. The railway switching system of claim 9, wherein the intelligent electronic circuit controller comprises a control unit having a processing unit and a memory.

11. The railway switching system of claim 10, wherein the processing unit is structured to store data regarding performance of the switching machine.

12. The railway switching system of claim 10, wherein the intelligent electronic circuit controller further comprises a communication unit structured to communicate between the control unit and external devices via one or more wired or wireless communication means.

13. The railway switching system of claim 10, wherein the processing unit is programmed to log a quantity of said movements of one or both of the first point detector bar and the second point detector bar between said first and second positions along with one or more of: a time duration required to compete each of said movements and a current draw of the switching machine during one or more of said movements.

14. The railway switching system of claim 13, wherein the processing unit is further programmed to compare one or more of the time duration and current draw to a predetermined value and provide an signal if the comparison satisfies a predetermined condition.

* * * * *